United States Patent [19]

Schafer

[11] Patent Number: 5,054,173

[45] Date of Patent: Oct. 8, 1991

[54] METHOD AND APPARATUS FOR THE ENHANCED CRIMPING OF MULTIFILAMENT YARN

[75] Inventor: Klaus Schafer, Wuppertal, Fed. Rep. of Germany

[73] Assignee: Bármag AG, Remscheid, Fed. Rep. of Germany

[21] Appl. No.: 517,211

[22] Filed: May 1, 1990

[30] Foreign Application Priority Data

May 18, 1989 [DE] Fed. Rep. of Germany ..... 3916240

[51] Int. Cl.[5] ..... D02J 11/00

[52] U.S. Cl. ..... 28/263; 57/333

[58] Field of Search ..... 28/252, 262, 263, 265, 28/258; 57/264, 289, 333

[56] References Cited

U.S. PATENT DOCUMENTS

| | | | |
|---|---|---|---|
| 3,234,626 | 2/1966 | Faria | 28/258 X |
| 3,373,470 | 3/1968 | Joly | 28/72 |
| 3,482,294 | 12/1969 | Joly | 28/1 |
| 3,889,327 | 6/1975 | Joly et al. | 28/252 |
| 3,924,311 | 12/1975 | Stanley | 28/258 X |
| 4,030,169 | 6/1977 | Enneking et al. | 28/265 X |
| 4,118,843 | 10/1978 | Schippers et al. | 28/255 |
| 4,135,280 | 1/1979 | Li et al. | 28/265 X |
| 4,183,202 | 1/1980 | Morihashi | 57/289 X |
| 4,345,425 | 8/1982 | Negishi et al. | 28/258 X |
| 4,578,940 | 4/1986 | Negishi et al. | 57/289 |
| 4,724,588 | 2/1988 | Runkel | 28/255 |
| 4,821,503 | 4/1989 | Stalder et al. | 57/264 |
| 4,829,640 | 5/1989 | Greb et al. | 28/255 |
| 4,858,288 | 8/1989 | Hodgin et al. | 57/333 X |

FOREIGN PATENT DOCUMENTS

| | | | |
|---|---|---|---|
| 695165 | 9/1964 | Canada | 28/258 |
| 0133198 | 2/1985 | European Pat. Off. . | |
| 2632083 | 1/1978 | Fed. Rep. of Germany . | |
| 3915691 | 11/1989 | Fed. Rep. of Germany . | |

*Primary Examiner*—Werner H. Schroeder
*Assistant Examiner*—John J. Calvert
*Attorney, Agent, or Firm*—Bell, Seltzer, Park & Gibson

[57] ABSTRACT

A method and apparatus for the intense crimping of a multifilament yarn in a stuffer box is disclosed, and wherein a false twist is imparted to the advancing yarn at a location upstream of the stuffer box, and with the intensity of the false twist being periodically or aperiodically varied.

16 Claims, 1 Drawing Sheet

METHOD AND APPARATUS FOR THE ENHANCED CRIMPING OF MULTIFILAMENT YARN

BACKGROUND OF THE INVENTION

The present invention relates to a method and apparatus for crimping a multifilament yarn in a stuffer box.

German PS 26 32 082 and U.S. Patent Nos. 3,373,470; 3,482,294; and 4,724,588 all disclose an apparatus for the continuous stuffer box crimping of a thermoplastic yarn, and wherein a heated treatment fluid advances the yarn by means of an injector into a stuffer box having a side wall which is permeable to the fluid. The yarn forms a closely packed filamentary body or plug in the stuffer box, and the yarn is drawn off from the stuffer box and wound into a package.

During the stuffer box crimping of multifilament yarns, it is among other things, an object to mingle the filaments of the individual yarns in such a manner that the individual filaments no longer appear in the finished yarn product. Attempts have been made to achieve this object by a particularly intensive stuffer box crimping, which is accomplished primarily by increasing the stuffer box pressure. In the case of pneumatic stuffer boxes this occurs in particular by the adjustment of the pressure and/or the temperature of the heating gas, heating air, or heating vapor, which is applied to the yarn and serves to advance the yarn into the crimping portion of the stuffer box.

In accordance with the present invention, it has been found that the intensification of the crimping in a pneumatic stuffer box can also be varied irrespective of the parameters of the pneumatic conveying component, and this is an object of the present invention.

SUMMARY OF THE INVENTION

The above and other objects and advantages of the present invention are achieved in the embodiment disclosed herein by the provision of a method and apparatus for crimping a multifilament yarn and which comprises the steps of advancing a multifilament yarn into a stuffer box to form a closely packed coherent filamentary body, and while imparting false twist to the advancing yarn at a location upstream of the stuffer box, and with the intensity of the false twist being periodically or aperiodically varied. The closely packed filamentary body may then be withdrawn from the stuffer box, cooled, and wound into a package.

It is possible to impart the false twist by increasing and decreasing the intensity of the twist in only one twist direction, it being not necessary to proceed from zero. However, the twist can also be imparted in opposite directions. Preferably, the false twist is imparted by an air nozzle, since an air nozzle permits the attainment of high frequencies for the change of the false twist. Further, the insertion of a false twist leads to a loosening of the yarn texture, i.e., to a separation of filaments adhering to each other.

It is possible to guide the yarn advancing from the false twist nozzle directly into the stuffer box. It is also possible and not detrimental to the intensification of the stuffer box crimping to guide the yarn one more time over a godet and cause it to be withdrawn therefrom before its entry into the stuffer box. As a particular example, a godet of this type can be a draw roll.

The false twist nozzle can also be arranged such that the yarn is simultaneously advanced by the impacting air jets. The number of the air channels which terminate in the yarn passageway allow the intensity of the twist insertion to be influenced.

The effect which an alternating twist insertion has on the intensification of the stuffer box crimping, is surprising. One has to assume that the alternating or pulsating false twist insertion leads to a movement and loosening of the compound between the individual filaments of the yarn and to a change of location of at least a few filaments. As a result, the individual filaments are subjected to a greater extent to the jets of the heated treatment fluid impacting on the yarn advancing into the stuffer box, and the filaments are more thoroughly shifted and intermingled.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
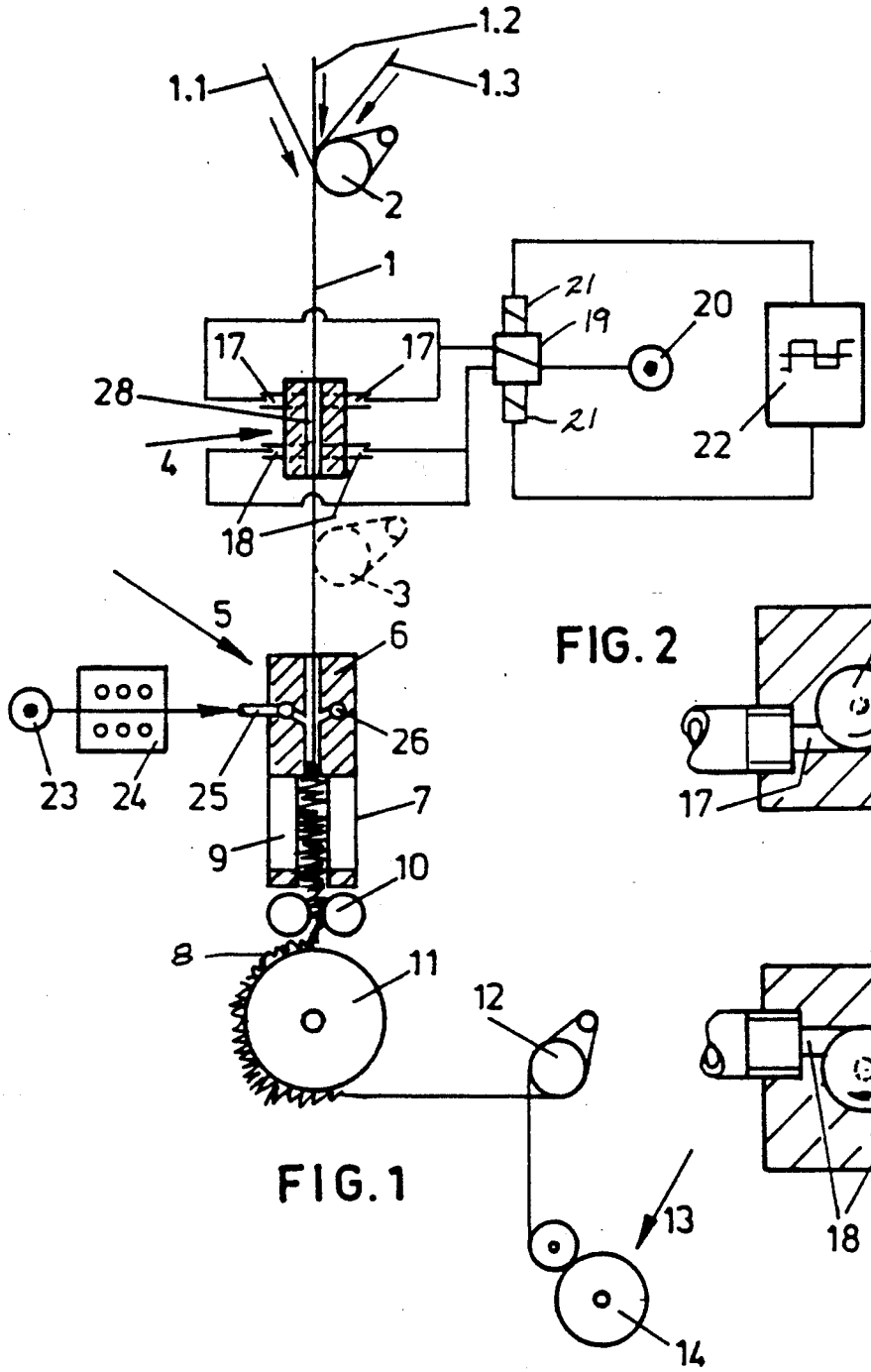
FIG. 1 is a schematic view of a stuffer box crimping apparatus which embodies the features of the present invention.

Referring more particularly to the drawings, FIG. 1 illustrates freshly spun manmade filament yarns 1.1, 1.2 and 1.3 which are withdrawn by a common feed system 2 and combined to form a multicomponent yarn 1. The yarn 1 then advances to a false twist nozzle 4, which will be described below. After having passed through the false twist nozzle, the yarn can be withdrawn by a further feed system, for example, a draw roll 3. In any event, the yarn passes through a yarn treatment chamber 5 after leaving the false twist nozzle 4.

The yarn treatment chamber 5 comprises an inlet portion 6, in which vapor jets are guided at a high velocity into the yarn passageway, and a stuffer box portion 7, in which the yarn is formed to a yarn plug 8. The yarn plug 8 is removed from the stuffer box portion by a feed system 10, and lateral slots 9 are provided in the wall of the stuffer box portion 7 to discharge the vapor. The yarn plug 8 is deposited on a perforated cooling drum 11 and withdrawn therefrom and simultaneously drawn out again to a yarn by a godet 12, as is described in more detail, for example, in DE-PS 26 32 082 and U.S. Pat. No. 4,724,588. Subsequently, the yarn is wound by a takeup system 13 to form a package 14. As aforesaid, the yarn inlet portion 6, is supplied with a treatment fluid. To this end, a fluid generator 23 is provided as well as a heating system 24, a fluid supply duct 25 and an annular duct 26, from which tap channels 27 proceed to terminate in the yarn passageway.

Figure 2:
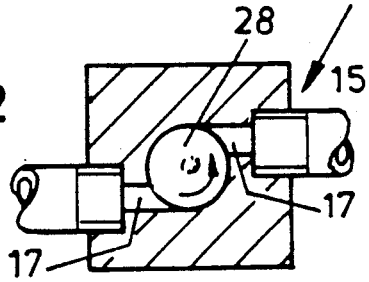
FIGS. 2 and 3 are enlarged cross-sectional views taken through the false twisting nozzle as seen in FIG. 1.
Figure 3:
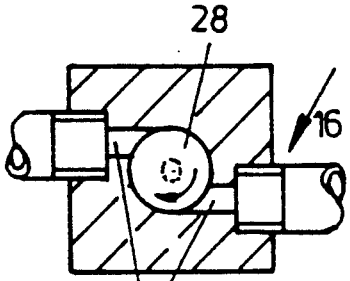

Prior to its entry into the inlet portion 6 of the chamber 5, an alternating false twist is imparted to the yarn 1, i.e., it is false twisted with alternating S and Z twists by the false twist nozzle 4. The latter possesses a left-hand twist component 15 and a right-hand twist component 16, which are shown respectively in FIGS. 2 and 3. In the illustrated embodiment, two pairs of air channels 17 and 18 terminate in the yarn passageway 28 of the twist nozzle. The air channels 17 and 18 terminate each tangentially in the yarn passageway 28, it being possible that the exiting air jets are also tangent to the direction of the yarn. The air channels 17 are directed into the yarn duct such that a left-hand twist, i.e., an S twist is imparted. The air channels 18 are directed into the yarn duct such that they impart a right-hand twist, i.e., a Z twist.

Compressed air is supplied to the air channels 17 and 18 via a two-way valve 19 in such a manner that the air channels 17 temporarily receive the compressed air, and likewise the air channels 18. The two-way valve 19 is switched by actuating means, such as, for example, magnets 21, which are energized by a preferably adjustable frequency transmitter 22. The frequency may be as high as 20 Hz and preferably ranges between about 0.5 to 10 Hz.

It has been found that this twist insertion method intensifies the stuffer box crimping such that differences of the several components 1.1, 1.2, 1.3 no longer appear.

It suffices to impart to the yarn an increasing and decreasing false twist in one direction, for example, by operating only one of the false twist nozzles 15 or 16. In this stance, the intenstity of the twist may vary in a range between zero and a given maximum value in one twist direction. However, a more intensive treatment is accomplished by alternating the twist in both directions in the manner described above.

In the drawings and specification, there has been set forth a preferred embodiment of the invention, and although specific terms are employed, they are used in a generic and descriptive sense only and not for purposes of limitation.

That which is claimed is:

1. A method of crimping a multifilament yarn and comprising the steps of advancing a multifilament yarn into a stuffer box to form a closely packed coherent filamentary body, and while imparting false twist to the advancing yarn at a location upstream of the stuffer box, and with the intensity of the false twist being periodically or aperiodically varied, and withdrawing the closely packed filamentary body from the stuffer box.

2. The method as defined in claim 1 wherein the intensity of the false twist varies frequency within the range of between about 0.5 to 20 Hz.

3. The method as defined in claim 1 wherein the intensity of the twist varies between two values in respectively opposite twist directions.

4. The method as defined in claim 1 wherein the intensity of the twist varies in a range between zero and a given maximum value in one twist direction.

5. The method as defined in claim 1 wherein the step of imparting false twist to the advancing yarn includes periodically or aperiodically applying at least one airstream tangentially to the advancing yarn.

6. The method as defined in claim 1 wherein the step of imparting false twist to the advancing yarn includes alternately applying a first airstream in a first tangential direction to the advancing yarn, and applying a second airstream in the opposite tangential direction to the advancing yarn.

7. The method as defined in claim 1 wherein the step of withdrawing the closely packed filamentary body from the stuffer box includes conveying the filamentary body onto the surface of a perforated cooling drum, and then winding the same into a package.

8. The method as defined in claim 1 wherein the step of advancing a multifilament yarn into a stuffer box includes directing a heated treatment fluid into contact with the yarn and with the treatment fluid having a directional component which serves to convey the yarn into the stuffer box.

9. The method as defined in claim 1 comprising the further step of contacting the advancing yarn with a feed roll at a location between the false twist imparting location and the stuffer box.

10. An apparatus for crimping a multifilament yarn and comprising a yarn treatment chamber comprising an inlet portion and a stuffer box portion, means for guiding an advancing multifilament yarn along a path of travel and into and through said yarn treatment chamber,and means positioned along said path of travel and upstream of said chamber for imparting false twist to the advancing yarn and such that the intensity of the false twist may be periodically or aperiodically varied.

11. The apparatus as defined in claim 10 wherein said means for imparting false twist to the advancing yarn comprises air treatment nozzle means for periodically or aperiodically applying at least one airstream tangentially to the advancing yarn.

12. The apparatus as defined in claim 11 wherein said air treatment nozzle means comprises a first air nozzle for applying a first airstream to the advancing yarn in a first tangential direction, and a second air nozzle for applying a second airstream to the advancing yarn in a second tangential direction.

13. The apparatus as defined in claim 12 wherein said air treatment nozzle means further comprises air supply valve means for alternately supplying pressurized air to said first and second air nozzles in a predetermined frequency.

14. The apparatus as defined in claim 10 wherein said inlet portion of said yarn treatment chamber comprises means for directing a heated treatment fluid into contact with the yarn passing therethrough and with the treatment fluid having a directional component which serves to convey the yarn into said stuffer box portion.

15. The apparatus as defined in claim 14 further comprising a perforated cooling drum positioned downstream of said yarn treatment chamber for receiving the treated yarn onto the surface thereof, and means positioned downstream of said cooling drum for winding the treated yarn into a package.

16. The apparatus as defined in claim 10 further comprising a feed roll positioned to contact the advancing yarn at a location between said false twist imparting means and said yarn treatment chamber.

* * * * *